US006439947B1

(12) United States Patent
Lehavi

(10) Patent No.: US 6,439,947 B1
(45) Date of Patent: Aug. 27, 2002

(54) MARKING SYSTEM AND METHOD FOR TOYS AND SIMILAR OBJECTS

(76) Inventor: Tali Lehavi, 1305 Crystal Dr., #1104, Arlington, VA (US) 22202

( * ) Notice: Subject to any disclaimer, the term of this patent is extended or adjusted under 35 U.S.C. 154(b) by 0 days.

(21) Appl. No.: 09/780,709

(22) Filed: Feb. 12, 2001

(51) Int. Cl.[7] ..... A63H 3/16

(52) U.S. Cl. ..... 446/101; 446/390; 446/369; 446/901

(58) Field of Search ..... 446/101, 901, 446/100, 369, 167, 397, 175; 434/258, 259, 168; 273/157 R, 156

(56) References Cited

U.S. PATENT DOCUMENTS 3,580,575 A * 5/1971 Speeth ..... 273/186
4,206,568 A * 6/1980 Garner ..... 446/153
4,372,077 A 2/1983 Baluena
4,614,505 A 9/1986 Schneider et al.
4,729,751 A * 3/1988 Schiavo ..... 446/268
5,071,385 A * 12/1991 Cox ..... 446/129
5,337,501 A * 8/1994 Amanze ..... 40/621
5,362,271 A * 11/1994 Butt ..... 446/139
5,531,625 A 7/1996 Zhong
5,645,437 A 7/1997 Meir
5,651,717 A 7/1997 Hamilton et al.
5,752,869 A 5/1998 Huff
5,897,421 A * 4/1999 Rink ..... 446/369
5,913,706 A 6/1999 Glickman et al.
5,944,477 A 8/1999 Yanofsky et al.
5,981,005 A 11/1999 Schiess
5,983,467 A 11/1999 Duffy
6,149,491 A 11/2000 Arad et al.
6,225,885 B1 * 5/2001 Lin ..... 335/206

* cited by examiner

*Primary Examiner*—Derris H. Banks
*Assistant Examiner*—Jamila Williams
(74) *Attorney, Agent, or Firm*—Jeffrey Weiss; Harry Weiss; Weiss & Moy, P.C.

(57) ABSTRACT

A system and method for providing a visible marker when at least two objects are combined. The visible marker may be any desired marking but, in the preferred embodiment, is a heart-shape. The two objects may be two-dimensional, such as cards, or three-dimensional, such as toys or household items. The creation of the visible marker by bringing two objects into proximity can show common origin and manufacture and, where a heart-shape is used, can send positive social and moral messages of love and togetherness.

12 Claims, 2 Drawing Sheets

MARKING SYSTEM AND METHOD FOR TOYS AND SIMILAR OBJECTS

BACKGROUND OF THE INVENTION

1. Field of Invention

This invention relates generally to toys and systems and methods for identifying them as having a common manufacturer, belong to a particular group, or the like, and more particularly, to a system and method for marking toys and similar objects whereby a distinctive mark is formed when two toys are coupled together in an appropriate manner.

2. Background of the Invention

It is often desired when a single manufacturer makes a variety of toys or similar objects in a series or collection to create awareness in the mind of the purchasing public that the toys or other objects are related. This is often accomplished by giving the objects a common look and feel—such as for example the stuffed animals in TY's® BEANIE BABIES® series. This can also be accomplished by assigning a common trademark to the objects, and placing such trademark on a tag, box or other convenient place.

However, where the objects are given a common look and feel, a manufacturer may be unable to successfully market other objects in the same series where those objects look or feel differently. With respect to the use of trademarks to foster product identification, this can be less visually compelling to a user and, moreover, trademarks placed on tags (such as those on BEANIE BABIES®) can fall off of the object.

A need therefore exists for a system and method for providing a visual identification for toys or similar objects in a series. The system and method should be useable for toys and objects having a similar look and feel, as well as for ones that do not appear to belong together. Moreover, it is preferred that the visual identification provided send a positive message beyond that of identifying the toys/objects as having a common origin. The present invention satisfies these needs and provides other, related advantages.

SUMMARY OF THE INVENTION

It is an object of the present invention to provide a system and method for providing a visual identification for toys or similar objects in a series.

It is a further object of the present invention to provide a system and method for providing a visual identification for toys or similar objects in a series that is useable for toys and objects having a similar look and feel, as well as for ones that do not appear to belong together.

It is a still further object of the present invention to provide a system and method for providing a visual identification for toys or similar objects in a series in which the visual identification provided sends a positive message beyond that of identifying the toys/objects as having a common origin.

BRIEF DESCRIPTION OF THE PREFERRED EMBODIMENTS

In accordance with one embodiment of this invention, a system for providing a visible marking when at least two objects are combined is disclosed. The system comprises, in combination: a first object having a portion thereon forming a first part of a marking; and a second object having a portion thereon forming a second part of the marking and coupleable to the portion on the first object so as to form the marking; wherein the marking is formed as an independent image interposed between the first and the second objects so that, upon the formation, each of the first object, the second object, and the marking located between the first object and the second object is visible.

In accordance with another embodiment of this invention, a method for visibly marking two or more objects when combined together comprising the steps of: providing a first object having a portion thereon forming one part of a marking; providing a second object having a portion thereon forming a second part of the marking and coupleable to the portion on the first object so as to form the marking; and coupling the portion on the first object to the portion on the object so as to form the marking; wherein the marking is formed as an independent image interposed between the first and the second objects so that, upon the formation, each of the first object, the second object, and the marking located between the first object and the second object is visible.

The foregoing and other objects, features, and advantages of the invention will be apparent from the following, more particular, description of the preferred embodiments of the invention, as illustrated in the accompanying drawings.

DETAILED DESCRIPTION OF THE PREFERRED EMBODIMENTS

Referring to FIGS. 1–6, the formation of a mark 10 is illustrated by the combination of mating portions 12 extending from two objects 14. The mark 10 is preferably a heart shape. This shape is preferred because it is visually pleasing and because the image of the heart conveys a number of positive meanings, such as love, friendship, peace, etc. The combination of bringing two objects together to form a heart shape sends a powerful positive message to a child or adult viewing such image. The positive messages of love, friendship, togetherness, etc. are particularly strong when the objects brought together are not identical, such as, for example: (a) human figures of different skin colors; (b) different kinds of animals; (c) human figures and animals; (d) plants and animals; (e) plants and human figures; etc. In this regard, the creation of such a powerful positive message could make the system of the present invention useful in a character development program or the like.

Although a mark 10 in the form of a heart is preferred, other shapes or images could also be created. For example, the mark 10 could be a letter corresponding to the first letter of the company making or selling the objects (e.g., the letter "A" for ABC Corp.), a symbol, an animal, or any other desired image or shape. The mark 10 in such form could be used to send a message (as with the heart shape described above), to indicate that two or more objects are part of a series or were sold by the same company, to entertain or amuse, or for any other desired purpose.

Figure 5:
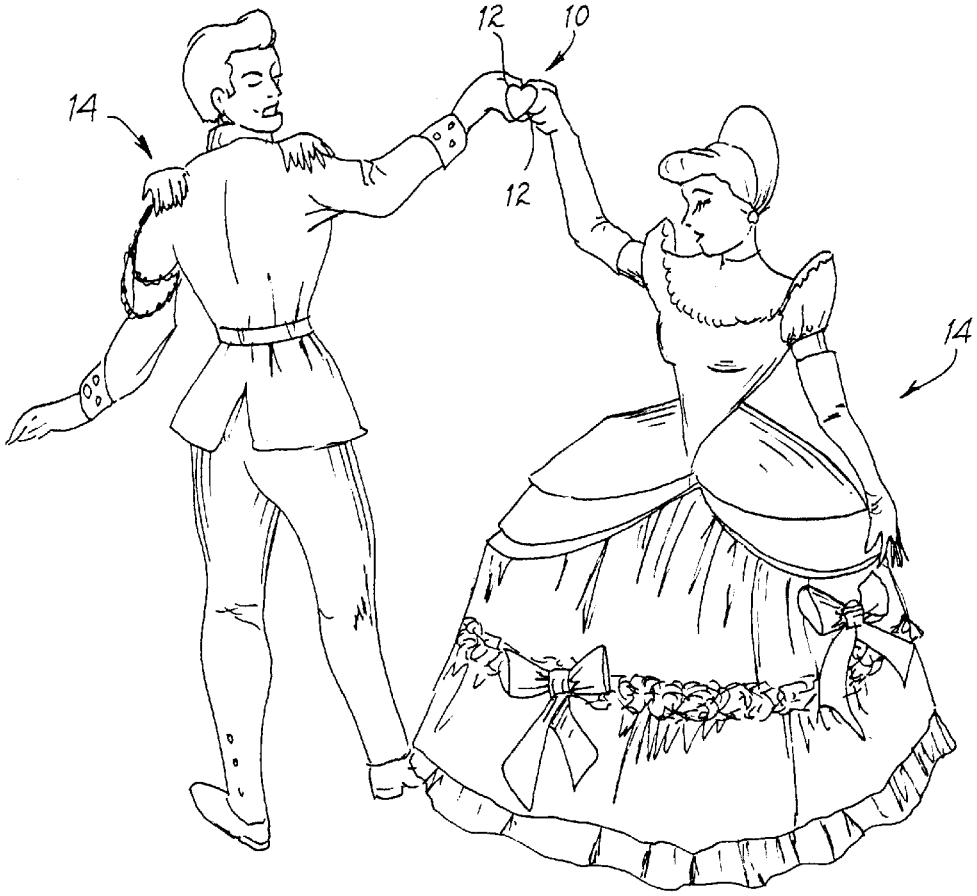
FIG. 5 is a perspective view of two objects, depicting a man and woman dancing, shown forming a mark as mating portions thereon are brought together.
Figure 6:
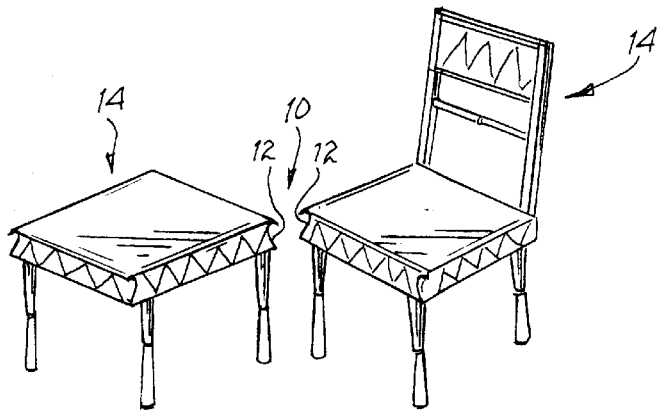
FIG. 6 is a perspective view of two objects, chairs, shown forming a mark as mating portions thereon are brought together.

The objects 14, in the preferred embodiment, are three-dimensional toys such as animals (FIGS. 2, 4), characters (FIG. 1), figurines (FIG. 5), dolls, crafts, action figures, etc. The objects 14 could be other three-dimensional objects of almost any type found in a household, such as a chair and ottoman (FIG. 6). The objects 14 could also be two-dimensional, such as greeting or other types of cards. The objects 14 could still further be electronic images.

Still further, the objects 14 could be persons, with the mating portions 12 located on the body of the persons (e.g., on the hand, arm, or any other desired place.) It may be desirable to position mating portions 12 on people for play or entertainment purposes, and as one example it would be desirable to position mating portions 12 on dancers performing a dance routine in which the mating portions 12 are brought together to form the mark 10 as part of the routine. (Where used with dancers, suitable instruction would of course need to be provided to the dancers in the proper movements necessary to bring the mating portions 12 into contact to form the mark 10.)

Figure 4:
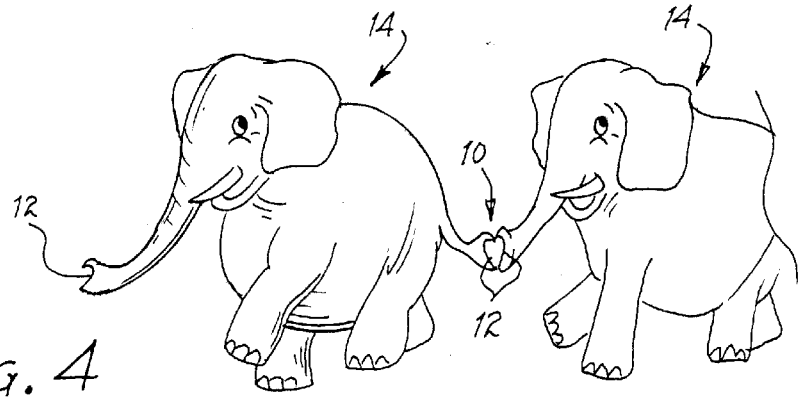
FIG. 4 is a perspective view of two objects, depicting elephants, shown forming a mark as mating portions thereon are brought together.

It can be seen from the drawing figures that the mark 10 is an image that is independent and different from that of the objects 14. Thus, referring to FIG. 2 by way of example, the objects 14 have the image of a bear, while the mark 10 is a heart. In FIG. 4, the objects 14 have the image of an elephant, while the mark 10 is a heart. Thus, upon formation of the mark 10, each of the objects 14 and mark 10 is visible, with the mark 10 interposed between the objects 14.

Figure 2:
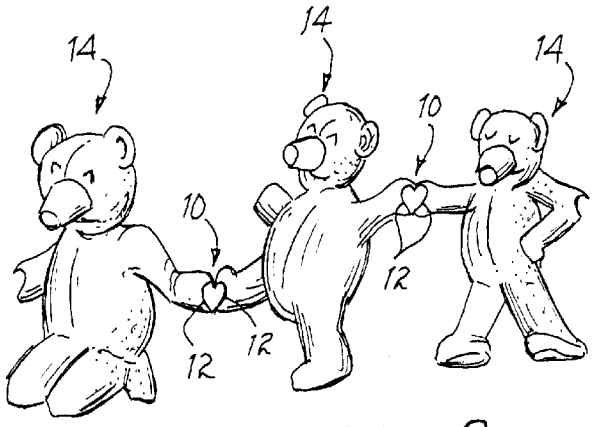
FIG. 2 is a front view of three objects, shown forming marks at the mating points therebetween as mating portions thereon are brought together.
Figure 1:
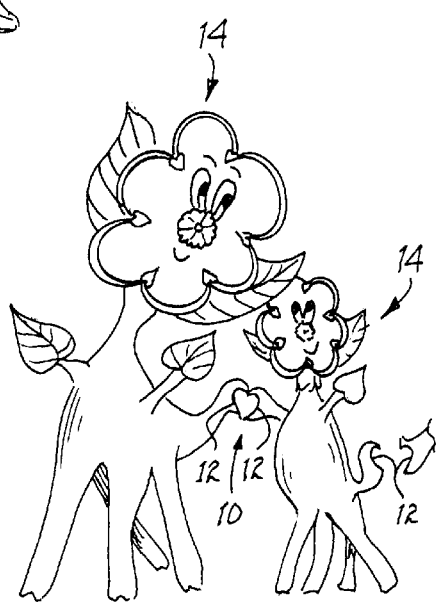
FIG. 1 is a front view of two objects, shown forming a mark as mating portions thereon are brought together.

The mating portions 12 are preferably pre-formed in the object 14, so that a user need only match the mating portions 12 to create the mark 10. It would also be possible to provide mating portions 12 made of a flexible material, so that the user would need to manipulate the material into the proper shape to form the mating portions 12. The mating portions 12 may be positioned in any desired place on an appendage or any other desired place on the object 14. For example, as shown in FIG. 2, the mating portions 12 may be located on an animal's hand, elbow, or foot. As shown in FIG. 4, the mating portions 12 can be located on an elephant's trunk and tail. As shown in FIG. 5, the mating portions 12 can be located on a person's hand. Still further, the mating portions 12 can be positioned on a non-animate type of object, such as on the edge of a chair, as shown in FIG. 6.

The mating portions 12 need not have thereon any means for permitting the secure coupling together of two mating portions 12. Thus, it could be sufficient for the mating portions 12 merely to be able to form the mark 10 for so long as the mating portions 12 are manually held together, with the mating portions 12 ceasing to form the mark 10 when no longer held in position. On the other hand, it would be possible to provide means on the mating portions 12 for a more secure fit, so as to allow objects 14 to be held relatively securely together about mark 10.

Figure 3A:
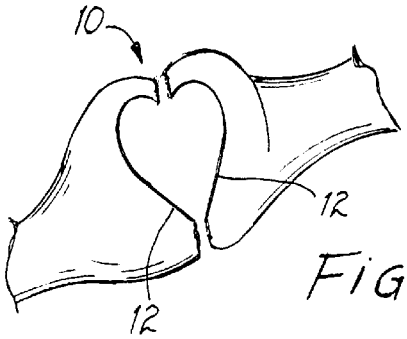
FIG. 3*a* is a perspective view of two mating portions being brought together.
Figure 3B:
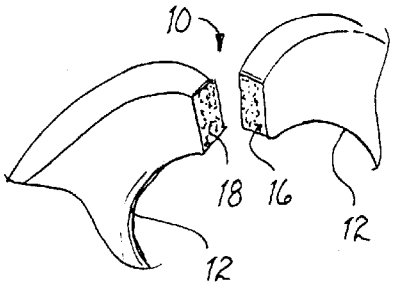
FIG. 3*b* is a perspective view showing the use of hook and loop material on the mating portions of FIG. 3*a*.
Figure 7:
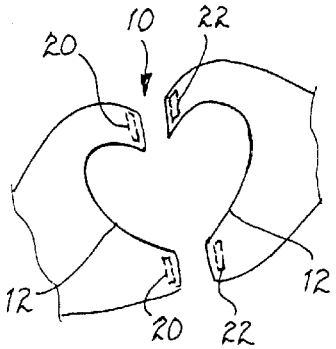
FIG. 7 is a front, cross-sectional view showing magnetic coupling of the mating portions.

Referring now to FIGS. 3*b* and 7, exemplary means of permitting a more secure coupling together of two mating portions 12 are shown. In FIG. 3*b*, the use of hook and loop material is shown, with hook material 16 located on one mating portion 12 and loop material 18 located on a second mating portion 12, positioned so that hook material 16 may releasable coupled to loop material 18 when the mating portions 12 are brought together. (While in FIG. 3*b* the hook and loop material 16 and 18 are only shown on an upper exposed surface of each mating portion 12, corresponding to the top of the heart shape, it should be understood that, preferably, hook and loop material 16 and 18 should correspondingly be placed on the lower exposed surface of each mating portion 12, corresponding to the bottom of the heart shape.)

In FIG. 7, the use of magnetism to couple mating portions 12 is shown. Thus, a first magnet 20 is positioned on each of upper and lower exposed surfaces of a mating portion 12. On the upper and lower exposed surfaces of a second mating portion 12, a material 22 is positioned. The material 22 may be either a second magnet, or a metal surface having an ability to be attracted by the first magnet 20.

The use of hook and loop material and magnets as means for more securely coupling two mating portions 12 is exemplary only. Other means could be employed, including for example adhesives, pins, screws, zippers, interlocking structures (for example, having a male member extending from one mating portion 12 and an corresponding female portion located in a second mating portion 12 and adapted to receive the male member), etc.

It is further possible to provide means for creating a sound, visual or other effect when the two mating portions 12 are joined. For example, a power source and a circuit could be provided, wherein the coupling together of the mating portions 12 would cause the closure of the circuit. This, or any other appropriate means (e.g., computer software), could create a sound (e.g., a giggle, jingle, etc.), light, written display, scent, tactile change, water spouting, color change (e.g., a blushing doll), an animated transformation, or other effect when the two mating portions 12 are joined. Such effect could be created at the mark 10, on one or more of the objects 14, or some combination thereof.

While the invention has been particularly shown and described with reference to preferred embodiments thereof, it will be understood by those skilled in the art that the foregoing and other changes in form and details may be made therein without departing from the spirit and scope of the invention.

I claim:

1. A system for providing a visible marking when at least two objects are combined comprising, in combination:

a first object having a first mating portion thereon forming a first part of a marking; and a second object having a second mating portion thereon forming a second part of said marking and coupleable to said first mating portion on said first object so as to form said marking;

wherein said marking is formed as an independent image interposed between said first and said second mating portions so that, upon said formation of said marking as said independent image, each of said first object, said second object, and said marking located between said first mating portion and said second mating portion is visible.

2. The system of claim 1 wherein at least one of said first object and said second object is a toy.

3. The system of claim 2 wherein said toy has the appearance of one of an animal and a person and wherein said first mating portion forming said first part of said marking is located on an extremity.

4. The system of claim 1 wherein said marking is a heart.

5. The system of claim 1 wherein said first mating portion on said first object has one of hook and loop material thereon and wherein said second mating portion on said second object has the other of said hook and loop material thereon so that said hook material and said loop material will couple to one another when said first mating portion on said first object is coupled to said second mating portion on said second object.

6. The system of claim 1 wherein said first mating portion on said first object has a first magnet thereon and wherein said second mating portion on said second object has one of a second magnet and a material having an ability to be attracted by a magnet thereon so that said first magnet and said one of said second magnet and said material having an ability to be attracted by a magnet will couple to one another when said first mating portion on said first object is coupled to said second mating portion on said second object.

7. A method for visibly marking two or more objects when combined together comprising the steps of:

providing a first object having a first mating portion thereon forming one part of a marking;

providing a second object having a second mating portion thereon forming a second part of said marking and coupleable to said first mating portion on said first object so as to form said marking; and coupling said first mating portion on said first object to said second mating portion on said second object so as to form said marking;

wherein said marking is formed as an independent image interposed between said first and said second mating portions so that, upon said formation of said marking as said independent image, each of said first object, said second object, and said marking located between said first mating portion and said second mating portion is visible.

8. The method of claim 7 wherein at least one of said first object and said second object is a toy.

9. The method of claim 7 wherein said marking is a heart.

10. The method of claim 7 further comprising the steps of:

providing one of hook and loop material on said first mating portion on said first object and the other of said hook and loop material on said second mating portion on said second object;

coupling said hook material and said loop material to one another when said first mating portion on said first object is coupled to said second mating portion on said second object.

11. The method of claim 7 further comprising the steps of:

providing a first magnet on said first mating portion on said first object and one of a second magnet and a material having an ability to be attracted by a magnet on said second mating portion on said second object;

coupling said first magnet to said one of said second magnet and said material having an ability to be attracted by a magnet to one another when said first mating portion on said first object is coupled to said second mating portion on said second object.

12. The method of claim 7 further comprising the step of providing a discernible effect when said first mating portion on said first object is coupled to said second mating portion on said second object.

* * * * *